United States Patent [19]

Alfredeen

[11] Patent Number: 5,025,124

[45] Date of Patent: Jun. 18, 1991

[54] ELECTROMAGNETIC DEVICE FOR HEATING METAL ELEMENTS

[76] Inventor: Lennart A. Alfredeen, 3633 Deer Spring Dr., Bettendorf, Iowa 52722

[21] Appl. No.: 532,286

[22] Filed: Jun. 1, 1990

[51] Int. Cl.[5] ..... H05B 6/10

[52] U.S. Cl. ..... 219/10.75; 219/10.57; 219/10.67; 219/10.79; 336/234

[58] Field of Search ..... 219/10.75, 10.79, 10.67, 219/10.57, 10.41, 10.491; 336/234

[56] References Cited

U.S. PATENT DOCUMENTS

| | | | |
|---|---|---|---|
| 1,335,453 | 3/1920 | Nilson | 219/10.79 |
| 2,226,446 | 12/1940 | Smith et al. | 219/10.41 |
| 3,965,321 | 6/1976 | Brinkmann et al. | 219/10.57 |
| 4,281,234 | 7/1981 | Dohogne | 219/10.79 |
| 4,673,781 | 6/1987 | Nuns et al. | 219/10.75 |
| 4,856,097 | 8/1989 | Mohr | 219/10.79 |

*Primary Examiner*—Philip H. Leung

*Attorney, Agent, or Firm*—Rockey & Rifkin

[57] ABSTRACT

A magnetic field heating device for heating metal including a means to create an alternating magnetic field passing this magnetic field through a dissimilar metal part to uniformly heat the part. This differs from induction heating of metal parts because the part is heated uniformly rather than being restricted to the skin or outside portions of the part. This unique heating is accomplished by utilizing a novel magnetic loop for creating a high density alternating magnetic field in the metal part to be heated.

6 Claims, 1 Drawing Sheet

ELECTROMAGNETIC DEVICE FOR HEATING METAL ELEMENTS

BACKGROUND OF THE INVENTION

This invention relates to a novel method for heating metallic parts.

It has been known that there are only a few basic mechanisms systems or methods for creating heat in a metallic part. Convection heating can be used which may include direct flame, immersion, radiation, electrical resistance where the heating of the metal is caused by the flow of the electricity and heat may be created by mechanical tresses or friction. Included among these has been induction heating where the heating is caused by use of magnetic fields. As is well known in the induction heating art, a metal workpiece is placed in a coil supplied with alternating current and the workpiece and the coil are linked by a magnetic field so that an induced current is present in the metal. This induced current heats the metal because of resistive losses similar to any electrical resistance heating. The coil normally becomes heated and must be cooled in order to make the heating of the workpiece as effective as possible. The density of the induced current is greatest at the surface of the workpiece and reduces as the distance from the surface increases. This phenomenon is known as the skin effect and is important because it is only within this depth that the majority of the total energy is induced and is available for heating. Typical maximum skin depths are three to four inches for low frequency applications. In all induction heating applications, the heating begins at the surface due to the eddy currents and conduction carries heat into the body of the workpiece. Another method of heating metal parts using magnetic fields is called transfer flux heating. This method is commonly used in heating relatively thin strips of metal and transfers flux heat by a rearrangement of the induction coils so that the magnetic flux passes through the workpiece at right angles to the workpiece rather than around the workpiece as in normal induction heating. Magnetic flux passing through the workpiece induces flux lines to circulate in the plane of the strip and this results in the same eddy current loss and heating of the workpiece.

Another method of induction heating utilizing direct current is described in an article by Glen R. Moore in the *Industrial Heating Magazine* of May, 1990, page 24. In this new heating method, direct current is utilized and the current flows in the axial direction of the workpiece because of the rotation of the workpiece rather than the rotation of the field about the workpiece. This method is also described as being able to heat a slab of metal which is the DC method of transfer flux heating. This method also utilizes a skin effect and a method of determining the penetration for a direct current field as is described in the article.

However, none of these heating systems provides for the uniform heating of a workpiece without conduction changes from the outside either in a magnetic field or in the direct flame method or related methods.

Therefore, it is desirable to make use of this novel magnetic field technology to overcome the disadvantages of the prior art as well as improving the efficiency of heating a workpiece uniformly throughout its cross-section.

SUMMARY OF THE INVENTION

An object of the present invention is to provide a method of uniformly heating a metal workpiece throughout both its cross-section and length. It is another object of this invention to accomplish such heating with a minimum the loss of heat in the coils and in the skin effect of the part and without utilizing conduction. These and other objects of the invention are accomplished by a novel magnetic field system which permits, indeed, accomplishes the uniform heating of any metal part placed in the magnetic field generated by this novel system. The magnetic field is generated by a magnetic loop including a plurality of thin plates also includes an air gap into which the workpiece can be placed. The workpiece then is included and becomes a part of the magnetic loop. The magnetic field generated by the system passes through the workpiece as it does the remainder of the loop. This magnetic system works best at 50 to 60 cycles; however, this means that the system can use normal electrical power delivered by an available outlet in all commercial installations.

The invention also will heat uniformly non-magnetic metals which are placed in the air gap of the magnetic loop. Numerous tests have been conducted that show that the entire cross-section of regular and irregular parts can be brought uniformly up to the desired temperature with a very rapid heating for these parts.

DETAILED DESCRIPTION OF A PREFERRED EMBODIMENT OF THE INVENTION

Figure 1:
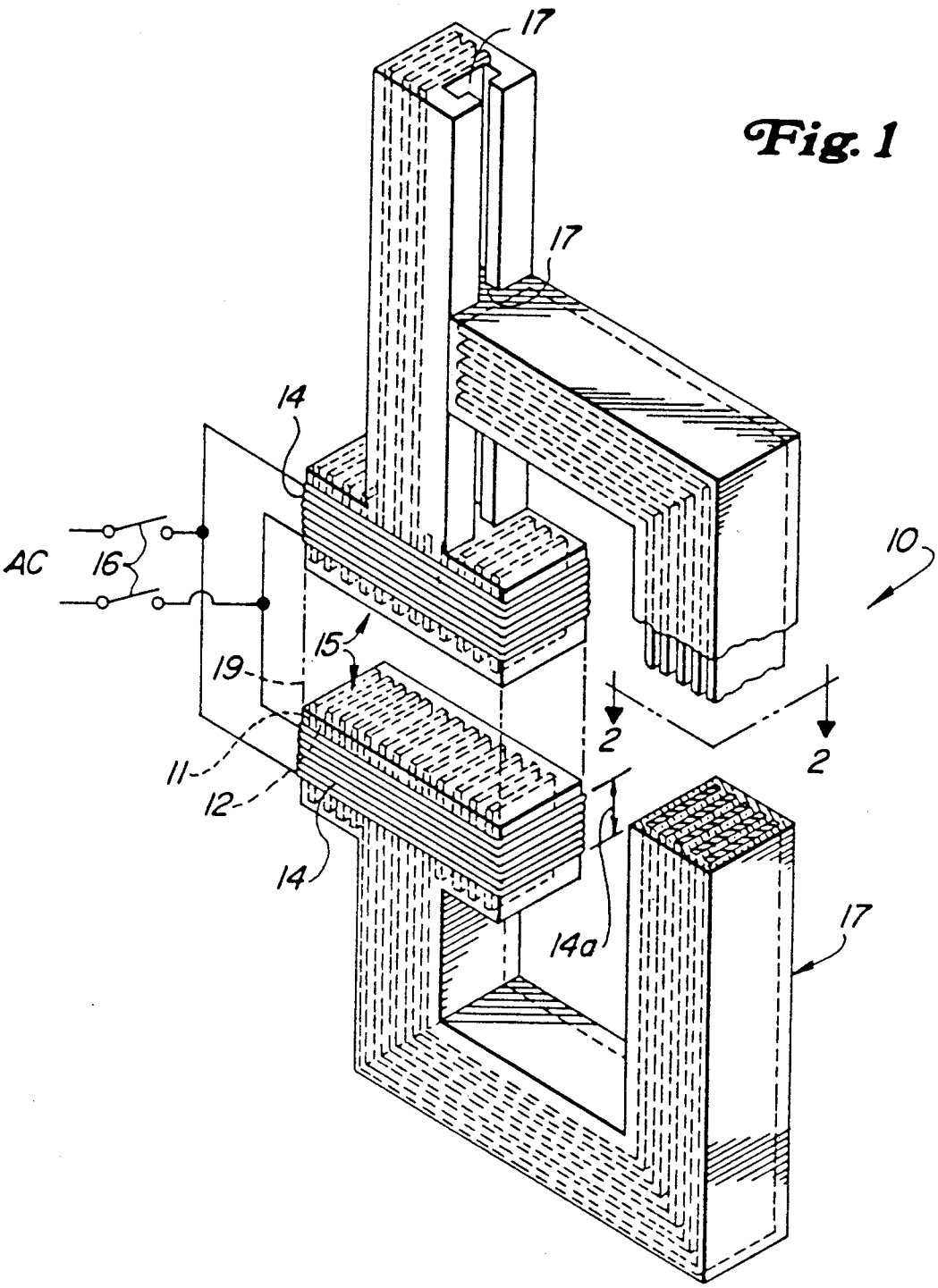
FIG. 1 is an illustration of the novel magnetic system of this invention.
Figure 2:
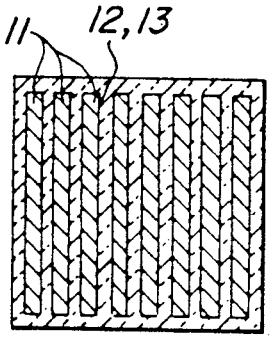
FIG. 2 is cross-sectional view of FIG. 1 at 2—2 showing the details of the laminations.

As seen in FIG. 1 a magnetic loop system is 10 shown. This magnetic loop 10 consists of a plurality of metal strips 11 formed into a magnetic loop laminated structure. Magnetic strips 11 are high permeability silicon steel in a preferred embodiment although any high permeability material may be used. Metal strips 11 have insulation 12 attached or adhered to the metal strips. This insulating is normally done by the manufacturer of the metal strips and may be accomplished any well known method. Any good electrical insulation material can be used. The metal strips 11 have a maximum thickness of 1.0 millimeter and may have a minimum thickness of the thinnest possible sheet that can be made. The thinner the sheets of high permeability material, the better the performance of the system. Maximum efficiency material would be 0.0001 millimeters or thinner; however, it is not now commercially available. In the novel system, the magnetic loop was constructed with 0.30 millimeters silicone steel for the metal strips 11. These metal strips 11 are formed in the desired shape normally in the shape of a square as shown in FIG. 1. The strips are then placed in a vacuum chamber with epoxy or mucilage 13, so thin it becomes part of insulation 12. Vacuum is created in the chamber and all foreign material is evacuated. The epoxy or mucilage then is bonding the strips together when the vacuum is removed. This is currently the best known method of making this magnetic loop; however, utilizing metal strips, insulation and some mucilage and/or a mechanical means to bind the strips together to make the laminate would be satisfactory.

As shown in FIG. 1, there are two core areas 15. This core area may be of any size or configuration from square to rectangles to circles or cylinders. The core area maybe chosen to fit the exterior of the workpiece which is to be heated. If a large workpiece is to be heated, a large core area 15 should be used. The magnetic field system or loop works at its maximum efficiency when the workpiece is contained firmly between the two cores 15 so that the magnetic lines may pass from the core directly through the workpiece from one core to the other. The core area 15 may be moved to vary the gap to fit the workpiece. There is one relation between the length of the coil and the density or height of the coil which results in optimum performance. To date, the critical relationship has been found only empirically. In addition, on each core 15 there is wound a coil 14. The configuration of the coil winding is critical for uniform heating. The number of turns of the coil and the dimensions are critical in order to prevent induction heating with the resulting surface effect and losses in the system. It has also been found that the number of turns and the height of the core as related to the distance between the face of the cores is important.

As shown in FIG. 1 the core area 15 is for transmission of the magnetic forces within the core system 10 into a laminate area 17 having a different size from the core. This laminate area is equal to the square root of AB. A and B being the length and width of the core area 15. This change in area of the laminates within the system produces an increased magnetic transfer between the core and through the workpiece. However, it is not necessary to change this size and the entire core system lamination could be the same size as the core area, though the heating will not pass as efficiently.

An A/C connection is shown at 16 these are connected to the coil and the coils are connected together by a wire in parallel or in series 19. In operation the alternating current is applied to the connections 16 from an alternating current source not shown and is 60 cycles or whatever the frequency of the line in the particular area is. As this alternating current voltage is applied across the coils 14 magnetic flux is created in the core areas 15 and flows between the two cores through the loop 10. Flux is analogous to current flow in a wire or fluid flow in a pipe. Magnetive motive force is the generator of the flux flow and in this particular instance a core of uniform core density has a measurable flux density of a number of webers per square meter. When alternating current is applied to the coils 14 it causes the magnetic intensity in the cores to alternate between positive and negative values. This could be applied on a magnetization curve normally called a hysteresis loop. Ferrous metal, can be magnetized and is organized into microscopic regions called magnetic domains. The electrons of the atoms in each domain rotate about the nucleus and spin about their own axis. The dominant movement is caused by electro spin and the net magnetic moment of each atom in a domain is oriented in the same direction. When alternating current is applied to the coils and a workpiece is placed between them, the domain boundaries of the workpiece are strained as a result of this rotation of the nucleus, etc. The result is frictional or mechanical heat generation within the workpiece. Magnetic domains are normally uniformly distributed throughout the material and since the flux is uniform across the cross-section, heat is generated in the workpiece uniformly. For this magnetic field to uniformly heat the workpiece, it is necessary that the loop material be of higher permeability than the material to be heated. A 5" diameter by 5" steel block had thermo couples implanted in the center and on the surface. With the workpiece insulated to minimize the effective heat loss to the surrounding area, the workpiece was placed in the loop and the entire cross-section of the workpiece was rapidly (in about 4 minutes) and uniformly brought up to a temperature of 500 degrees C. The heating effect can continue until any desired temperature below the melting temperature of the metal being heated is reached. The time required to heat any particular workpiece is a function of the size of the workpiece and the strength of the magnetic field.

The core portions of the magnetic field loop are not heated because the material is selected such that the maximum size of the hysteresis loop for that material is not exceeded during the change of directions of the field. The workpiece part having a smaller hysteresis loop, that loop is exceeded by the magnetic forces during each alternating cycle and creates the heating of the workpiece.

This same magnetic field heating device will also operate on non-magnetic materials as long as these metals have crystalline structures which structures can be lined up by action similar to the action of domains of the magnetic materials. The crystalline structure will align itself until the structure is at or near its melting point. A similar effect on the crystalline structure of aluminum is seen when it is extruded. Heat is generated by the forceful mechanical upsetting of the crystalline structure.

Variations in other aspects of the preferred embodiment will occur to those versed in the art, all without departure from the spirit and scope of the invention.

I claim:

1. A device for heating metal comprising a magnetic loop open at two facing ends with an open space therebetween;

said magnetic loop comprising a plurality of parallel thin plates of high magnetic permeability conductive material;

said platen closely spaced and insulated from each other;

a plurality of core areas, each of said core areas adjacent each of said facing ends and comprising a second plurality of parallel thin plates of high magnetic permeability conductive material having a face at right angles to the plane of the plates larger in area than the area of the facing end of said loop; and, a plurality of windings formed of conductive wires, each of said windings would around each of said core areas adjacent said facing ends and connected to an alternating current source to reverse the magnetic field in said loop at the frequency of the alternating current source.

2. A device for heating metal in accordance with claim 1 wherein each of said plates has a thickness between 1.00 mm and 0.0001 mm.

3. A device for heating metal as defined in claim 1 wherein the dimension of said open space between the facing ends of the core areas is larger than the smallest dimension of the face of each of said core areas.

4. A device for heating metal as defined in claim 1 wherein one of said core areas is moveable at right angles to the other core area to adjust the dimension of said open space between the faces of said core areas.

5. A device for heating metal as defined in claim 1 wherein the area of each facing end of the plates in said loop has an area equal to or greater than the square of the area of one of the faces of said core areas.

6. A device for heating metal as defined in claim 1 wherein said windings have a relationship between the number of turns of the winding and the width and the length of the windings such that induction heating in the core is minimized.

* * * * *

UNITED STATES PATENT AND TRADEMARK OFFICE

CERTIFICATE OF CORRECTION

PATENT NO. : 5,025,124

DATED : June 18, 1991

INVENTOR(S) : Lennart A. Alfredeen

It is certified that error appears in the above—identified patent and that said Letters Patent is hereby corrected as shown below:

At Column 5, Line 1, after "square" insert --root--.

Signed and Sealed this

Tenth Day of November, 1992

*Attest:*

DOUGLAS B. COMER

*Attesting Officer*

*Acting Commissioner of Patents and Trademarks*